United States Patent [19]

Usman et al.

[11] Patent Number: 4,805,249

[45] Date of Patent: Feb. 21, 1989

[54] REHABILITATION BED

[75] Inventors: Pulukadang F. Usman, 21-506 Samon-cho, Shinjuku-ku, Tokyo; Tadanobu Mutou, Tokyo, both of Japan

[73] Assignee: Pulukadang Freddy Usman, Tokyo, Japan

[21] Appl. No.: 95,303

[22] Filed: Sep. 11, 1987

[30] Foreign Application Priority Data

Sep. 19, 1986 [JP] Japan ..... 61-221456
Apr. 24, 1987 [JP] Japan ..... 62-99909

[51] Int. Cl.[4] ..... A61G 7/02
[52] U.S. Cl. ..... 5/90; 5/60; 5/66; 5/80
[58] Field of Search ..... 5/90, 60, 66, 80; 297/DIG. 4, DIG. 10

[56] References Cited

U.S. PATENT DOCUMENTS

| | | | |
|---|---|---|---|
| 1,626,091 | 4/1927 | Macklin | 5/66 X |
| 4,127,906 | 12/1978 | Zur | 5/90 X |
| 4,190,913 | 3/1980 | DiMatteo et al. | 5/90 X |
| 4,258,445 | 3/1981 | Zur | 5/90 X |
| 4,282,613 | 8/1981 | Violante | 5/90 |
| 4,307,477 | 12/1981 | Jacobsen | 5/90 X |
| 4,409,695 | 10/1983 | Johnston et al. | 5/80 X |
| 4,658,450 | 4/1987 | Thompson | 5/90 X |

*Primary Examiner*—Ramon O. Ramirez
*Attorney, Agent, or Firm*—Browdy & Neimark

[57] ABSTRACT

A rehabilitation bed especially suitable for helping a patient stand up and begin walking includes a matress split into at least three parts and supported by suitably movable frame suport members, the mattress including a back and head supporting part which is raiseable in the usual way, and separate leg supporting parts which are movable outwardly away from one another so as to provide a central gap where the patient can put his feet without first shifting his waist toward the bed side.

4 Claims, 10 Drawing Sheets

REHABILITATION BED

FIELD OF THE INVENTION

This invention relates to a rehabilitation bed suitable especially for stand up and walk training, bowel evacuation training and so on.

BACKGROUND OF THE INVENTION

In the past, when a patient on a rehabilitation bed attempted to rise up from the bed, stand up on the floor and attempt to start walking, he could not put his feet on the floor without first shifting his waist toward the bed side. Especially to a patient in need of rehabilitation, such a waist shift motion was a heavy burden and, in addition, any conventional bed was very inconvenient for bowel evacuation.

To solve these problems, some improved types of beds were offered. Such beds were designed to partially sink down, enabling the patient to rise to a sit-down position without the waist shift motion and then stand up at the sink position or evacuate the bowel at the sit-down position. However, even the improved types do not suffice for walk training because the level gap between the sink position and the floor impeded efforts of the patient to walk and further the sink part of the bed was not easy for the trainee to walk on stably.

SUMMARY OF THE INVENTION

The present invention was made to solve the problems described above and to provide a rehabilitation bed as enables the patient to put his feet on the floor easily from the position of sitting on the bed and immediately to step forward with no difficulty for walk training or evacuating the bowel.

The bed of the present invention is characterized in that the lower mattress supporting the patient's legs is divided into right and left mobile mattresses which are designed to move apart from one another providing a gap therebetween and providing access to the floor surface. In one embodiment, at least the central parts of the right and left mobile mattresses are designed to descend and split respectively toward the right and left sides. The above-described central control parts of the mobile mattresses are supported by split-plates and the same split-plates are designed to descend and split with their positions kept horizontal toward the right and left sides with use of a parallel link mechanism.

In a second embodiment, the right and left mobile parts are designed to move horizontally toward the right and left sides respectively without descending.

DESCRIPTION OF THE PREFERRED EMBODIMENTS

FIGS. 1–10 refer to embodiments of a descending mattress type of bed while FIGS. 11–18 refer to embodiments of a non-descending mattress type of bed, in all embodiments the mattress having side moving capabilities.

Figure 1:
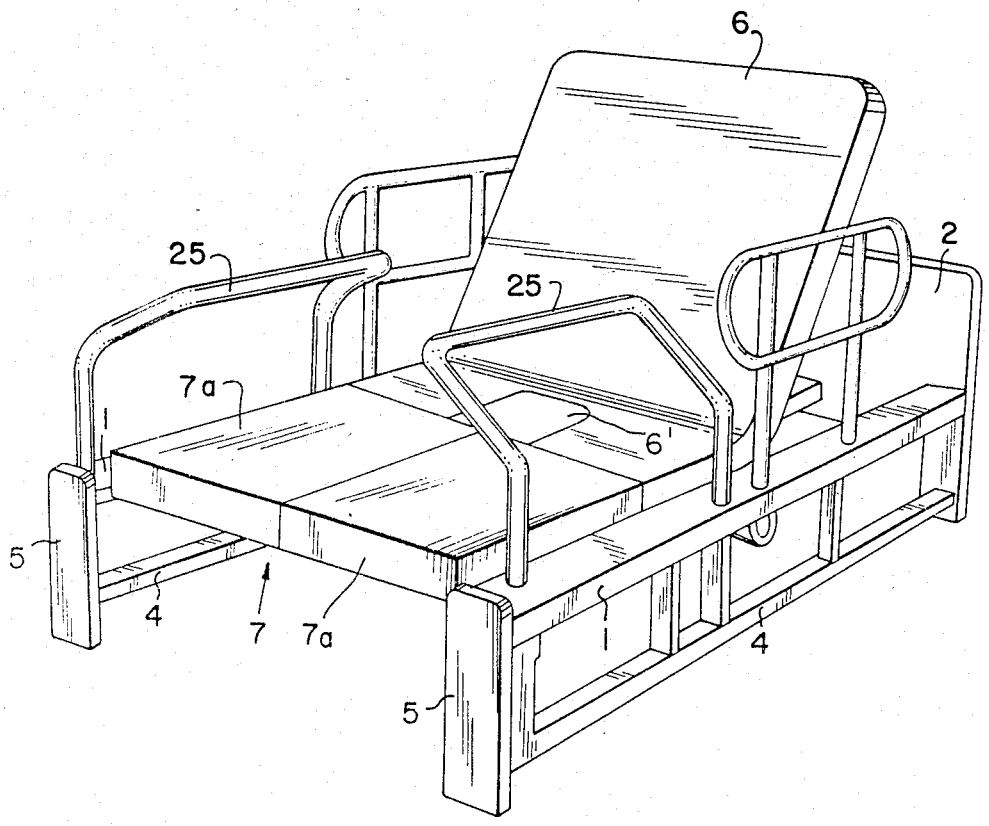
FIG. 1 is a perspective view of an embodiment of the bed of the present invention.
Figure 2:
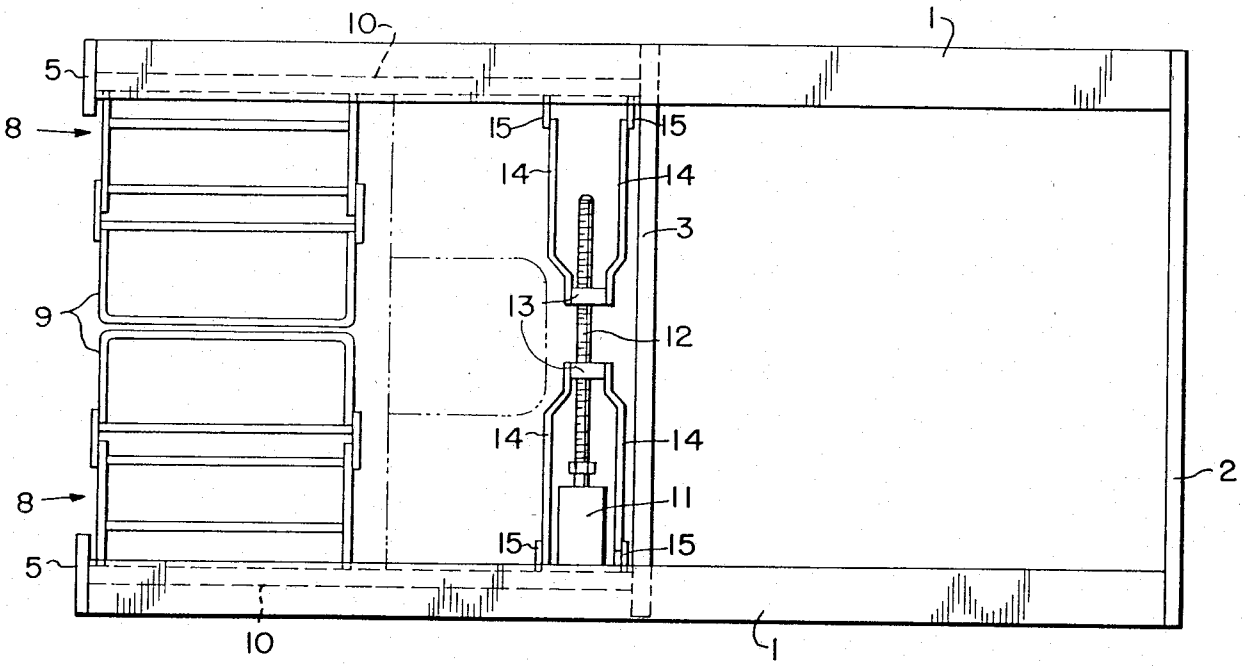
FIG. 2 is a plan view of the essential part of the mechanism for the embodiment of the present invention shown in FIG. 1.

In FIG. 1 and FIG. 2, bed is shown having main frames 1 made of angle steel with L-shaped sections, which are installed at the right and left sides of the bed. The rear ends (head side) of the main frames 1 are connected rigidly in unity with a head board 2; and the middle parts of the main frames 1 are connected by a connecting frame 3. Under the main frame 1 described above, auxiliary frames 4 made of angle pipe are installed in parallel. The front ends (leg side) of the main frame 1 and auxiliary frame 4 are provided with leg plates 5.

An upper mattress 6 is provided, which, as illustrated, can be raised up from a horizontal position with some known mechanism (not illustrated) and functions as the back rest of the patient in the sitting position. The upper mattress 6 has a central portion 6' for supporting the patient's waist and which is desirably designed to be removable for replacement with a bed pan or chamber pot. The lower mattress 7 supporting the patient's legs is divided into the right and left mobile mattresses **7*a* and 7a**.

Hand rails 25, which bend and overhand inwardly, extend upwardly from the main frames 1. Thus the patient is able to stabilize his position by gripping such hand rails 25 when standing up and starting walk training. The hand rails 25 are desirably removable.

Figure 3:
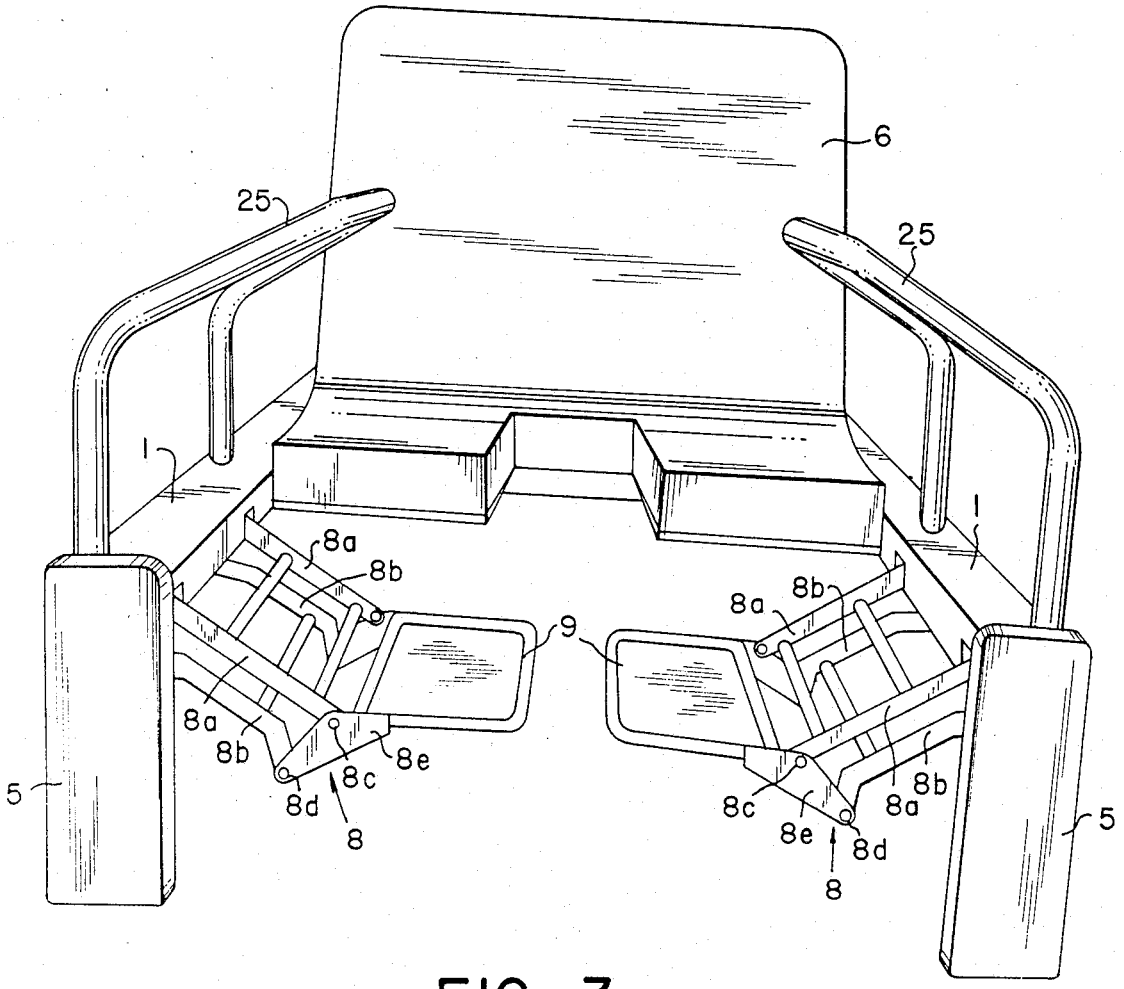
FIG. 3 is a perspective view of the bed of FIG. 1 at another stage of its use.

FIG. 3 shows the operating mechanism in a state where the mobile mattreses **7*a* and 7*a* are removed and split-plates 9, which in the positions of FIGS. 1 and 2 support the mobile mattresses, descend and split toward the right and left sides in coordination with the operation of a link mechanism 8**.

Figure 4:
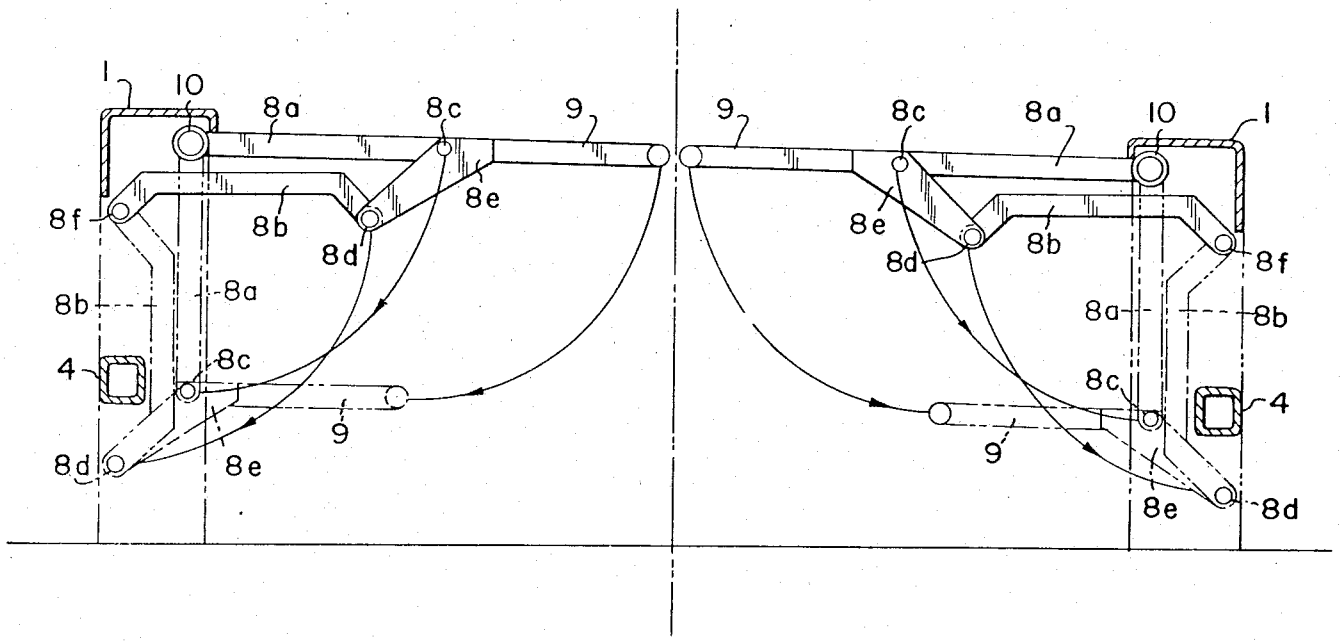
FIG. 4 shows a diagrammatic view of the descend-split mechanism used in the FIG. 1 embodiment of the bed of the present invention.

The link mechanims 8, clearly shown in FIGS. 3 and 4, consists of two parallel links 8*a* and 8*b* and operating pieces 8*e* attached with pin joints 8*c* and 8*d* to the tips of said parallel links, the basic end of said parallel link 8*a* being connected rigidly with a rotary drive shaft 10, and the basic end of the parallel link 8*b* being connected rotatively with the main frame 1 using a pivot pin 8*f*. The rotary drive shaft 10 is also pivoted rotatively to the main frame 1. Furthermore, the lengths of the parallel links 8*a* and 8*b* (i.e. the distance between the pin joint 8*c* and the rotary drive shaft 10 and the distance between the pin joint 8*d* and the pivot pin 8*f*) are equal and the distance between the rotary drive shaft 10 and pivot pin 8*f* and the distance between both pin joints 8*c* and 8*d* are equal, thus forming in the whole a parallelogram linkage.

When the rotary drive shafts 10 are driven to rotate, the operating pieces 8*e* along with the split plates 9 descend and split toward the right and left sides from the solid line illustrated position to the dot-dot-dash line illustrated position in FIG. 4, with the attitude of the split plates 9 remaining horizontal as illustrated in FIG. 4. The parallel links 8*b* are bent so as not to interfere with the auxiliary frames 4 when they rotate down as shown in FIG. 4.

Figure 5:
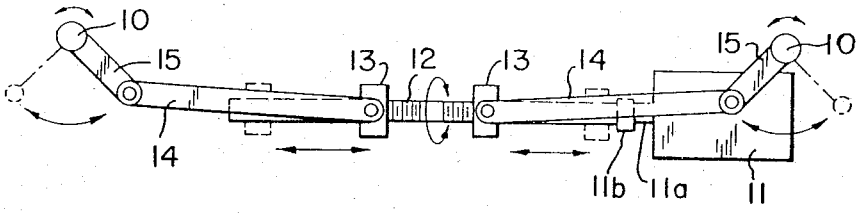
FIG. 5 is a diagrammatic view of the operation of the drive mechanism used in an embodiment of the bed of the present invention.

FIG. 5 shows the drive mechanism of said rotary drive shaft 10, as shown in place in FIG. 2. The output shaft 11*a* of an electric motor 11 is connected with a right and left hand screw shaft 12 through a joint 11*b*. The right and left hand screw shaft 12, threaded symmetrically on both the right and left sides, is provided with two travelers 13 engaged with the shaft, one traveler 13 on the right side and the other on the left side. The travelers 13 are pin-connected through connecting rods 14 with the operating pieces 15 fixed to the aforementioned rotary drive shaft 10. Therefore, when the electric motor 11 is powered to rotate the right and left hand screw shaft 12, the travelers 13 move to meet each other or oppositely away from each other along the right and left hand screw shaft 12. The movement of the travelers 13 is transmitted to the rotary drive shafts 10 through the connecting rods 14 and operating pieces 15, whereby the parallel link mechanism 8 is made to operate as shown in FIG. 4.

Figure 6:
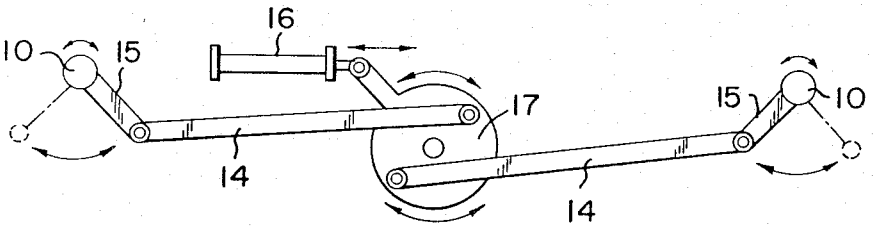

FIG. 6 shows another embodiment of the mechanism to rotate the above-mentioned rotary drive shafts 10, where a disk 17 is made to rotate by a hydraulic jack 16 or the like and the above-mentioned connecting rods 14 are pivoted to the disk 17, thus rotating the rotary drive shafts 10 through operating pieces 15.

Figure 7:
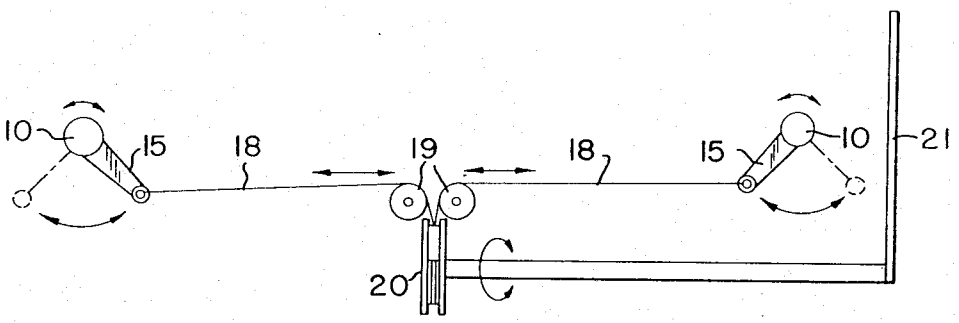
FIG. 6 and FIG. 7 are diagrammatic view of varied embodiments of the drive mechanism of the present invention.

FIG. 7 shows another embodiment of the mechanism to rotate the rotary drive shafts 10, where the above-mentioned operating pieces 15 are connected with wires 18 which are wound up by a winding pulley 20 through intermediate pulleys 19. The winding pulley 20 is driven with use of a hand lever 21. Specifically in this embodiment, the rotary drive shaft 10 is constantly loaded by the mobile mattresses 7*a* pulling the wires 18. Thus, easing the hand lever 21 causes the mobile mattresses 7*a* to descend and split toward the right and left sides.

Figure 8:
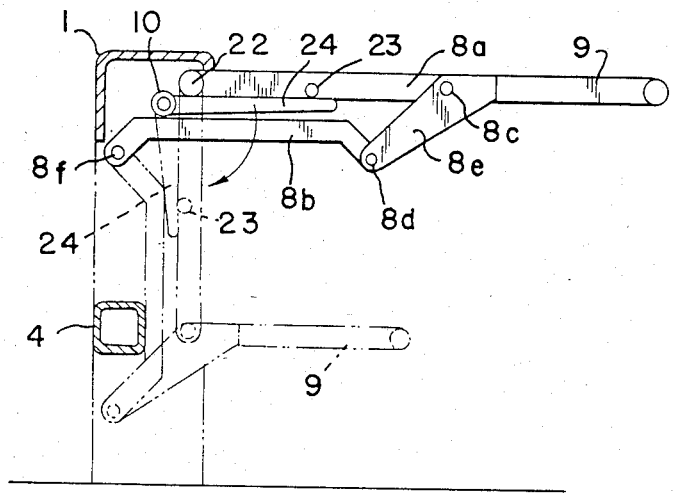
FIG. 8 is a diagrammatic view of another embodiment of the descend-split mechanism of the present invention.

FIG. 8 indicates another embodiment of the above described parallel link mechanism 8, where the basic end of the above-mentioned parallel link 8*a* is connected to rotate with the main frame 1 with use of a pivot pin 22, and an engaging pin 23 is mounted halfway of the parallel link 8*a*. In addition,the above-mentioned rotary drive shaft 10 is provided with a push up rod 24 which supports the engaging pin 23 upward by receiving it from the bottom side.

Figure 9:
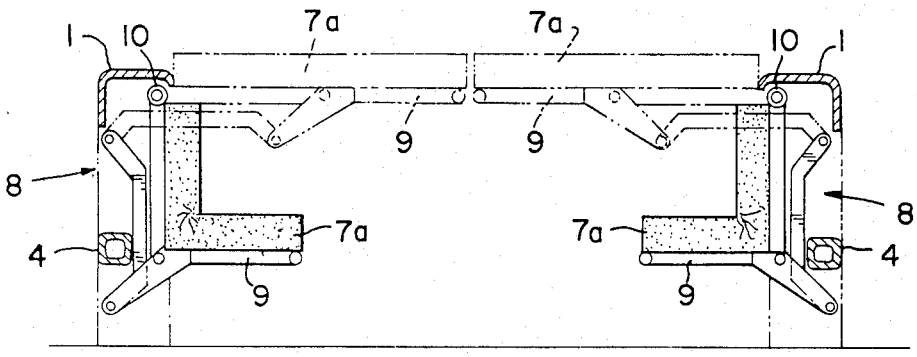
FIG. 9 and FIG. 10 are diagrammatic views showing the operation of the descending mobile mattreses of an embodiment of the present invention.
Figure 10:
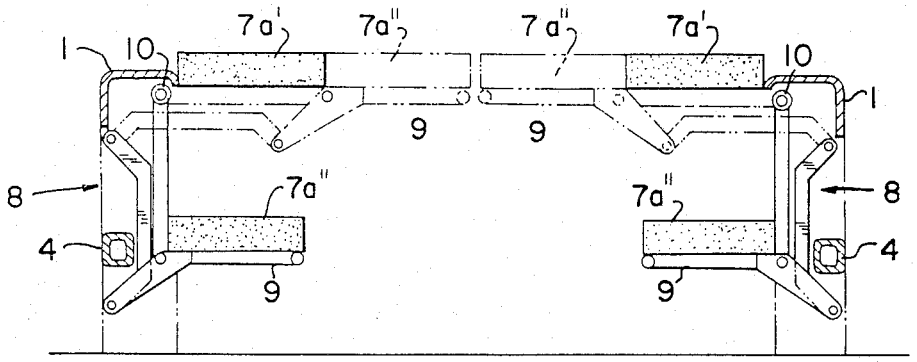

As shown in FIG. 9, the mobile mattress 7*a* is designed to descend and split in the embodiment described above, but the present invention is not limited to same. For instance, among the mobile mattresses 7*a*, only the inside mattresses 7*a*'' may be designed to descend and split with the outside mattresses 7*a*' remaining fixed. In this case, the width of each mattress 7*a*', 7*a*'' may be determined freely.

Figure 11:
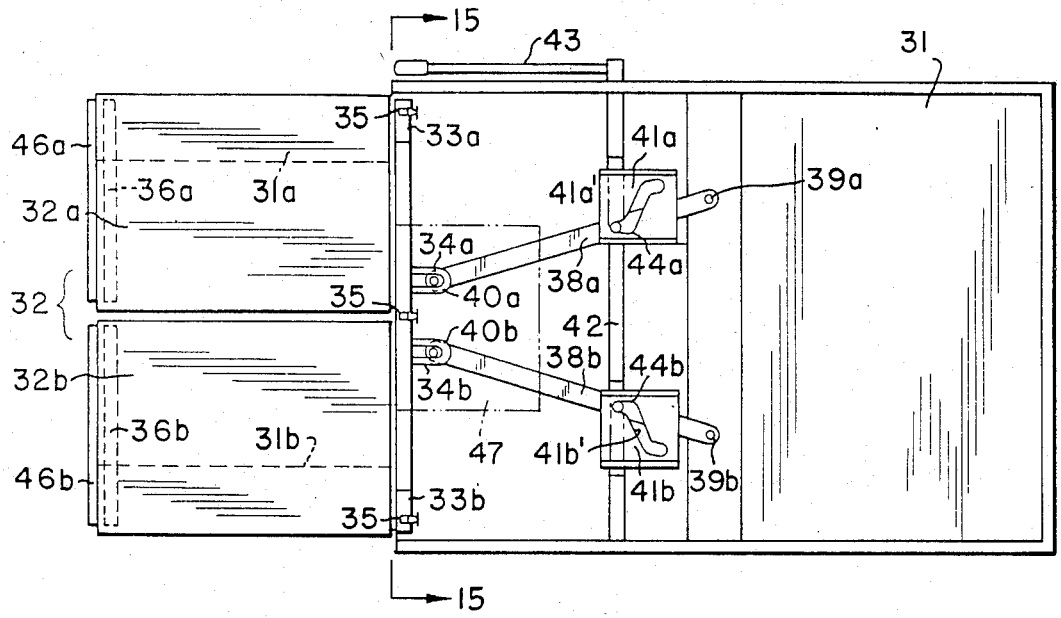
FIG. 11 is a schematic plan view showing another embodiment of the bed of the present invention.
Figure 12:
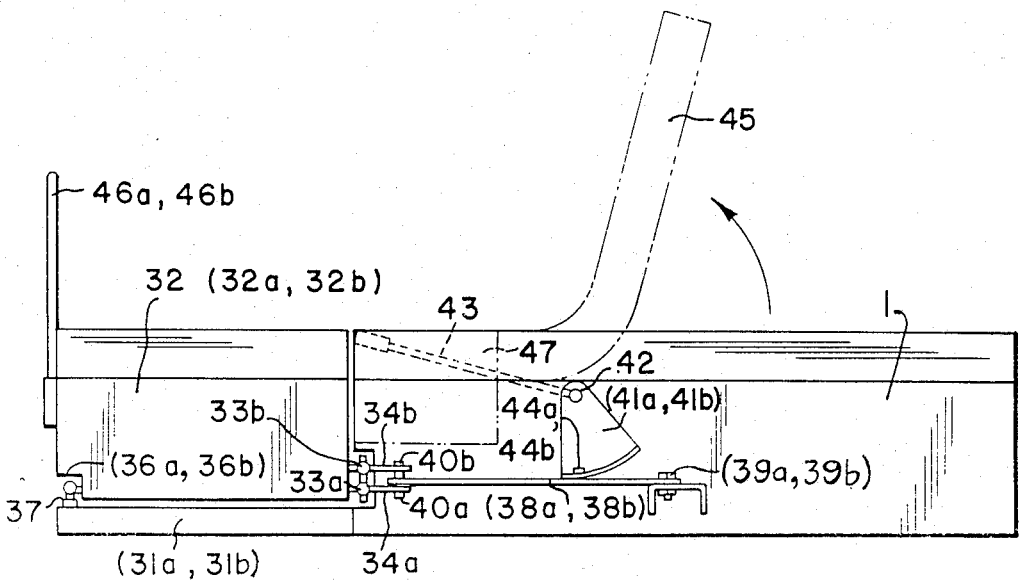
FIG. 12 is a schematic side view showing the embodiment of FIG. 11 of the bed of the present invention.

In FIG. 11 and FIG. 12, a non-descending mattress type of bed is shown having a fixed part 31 and a sideways movable part 32. The fixed part 31 supports the waist and upper half of the patient's body, and the movable part 32 bears mainly his legs. The same mobile part 32 is divided into a right side mobile part 32*a* and a left side mobile part 32*b*.

Figure 13:
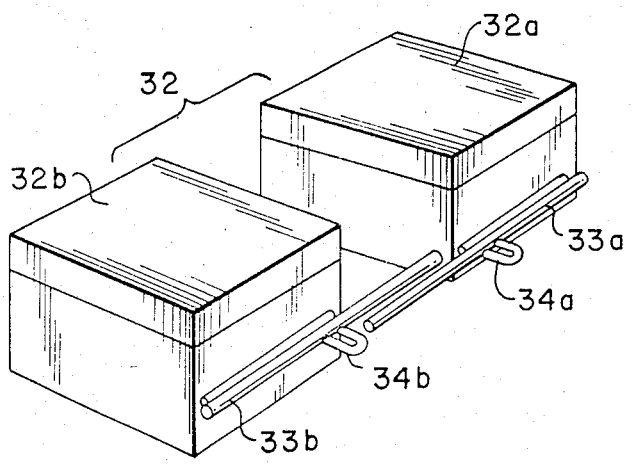
FIG. 13 is a perspective view showing the construction of the mobile part of the FIG. 11 embodiment of the bed of the present invention.
Figure 14:
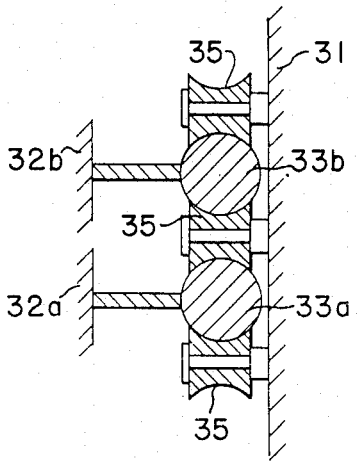
FIG. 14 is an enlarged sectional view showing the support of a slide pipe of the FIG. 11 bed of the present invention.

One side (opposite the fixed part) of the right side mobile part 32*a* is provided with a slide pipe 33*a* which extends to the left side mobile part 32*b*, as shown in FIG. 13. Also, one side of the left side mobile part 32*b* is provided with a slide pipe 33*b* which extends to the right side mobile part 32*a*. These slide pipes 33*a* and 33*b* are attached as shown in FIG. 14 respectively to a lower position and an upper position. The slide pipe 33*a* is provided with a U-shaped piece 34*a*; and the slide pipe 33*b* with a U-shaped piece 34*b*.

Figure 15:
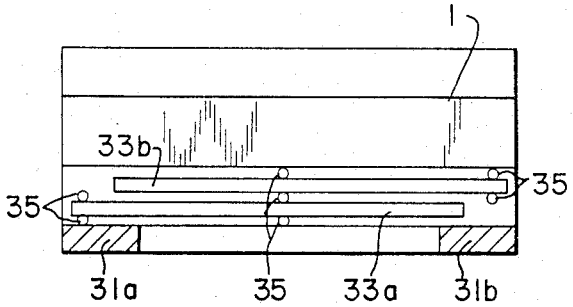
FIG. 15 shows an end view of an embodiment of the present invention taken along the 15—15 line of FIG. 11.

As illustrated in FIG. 14 and FIG. 15, the slide pipes 33*a* and 33*b* are supported by many roller bearings 35 mounted on the side of the fixed part 31, thus ensuring the sliding motion to the right and left directions. Furthermore, the other sides of the mobile parts 32*a* and 32*b* are also provided with supporting pipes 36*a* and 36*b* (see FIG. 12), which are supported by roller bearings 37 mounted on the tips of the support parts 31*a* and 31*b* extending from the aforementioned fixed part 31.

Operating rods 38*a* and 38*b* are provided to rotate from fixed part 31 using pivot pins 39*a* and 39*b*. The tips of the operating rods 38*a* and 38*b* are provided with pins 40*a* and 40*b* which fit into elliptical holes defined by the aforementioned U-shaped pieces 34*a* and 34*b*. Oscillating cam members 41*a* and 41*b* are connected fixedly with an operating shaft 42, thus rotating together with such shaft on its axis by the manipulation of the hand lever 43. The cam members 41*a* and 41*b* are provided with symmetrical slots 41*a*' and 41*b*' which hold the pins 44*a* and 44*b* of the aforementioned operating rods 38*a* and 38*b*, where by the oscillating motion of the oscillating cam members 41*a* and 41*b* causes the swinging motion of the operating rods 38*a* and 38b.

Figure 16:
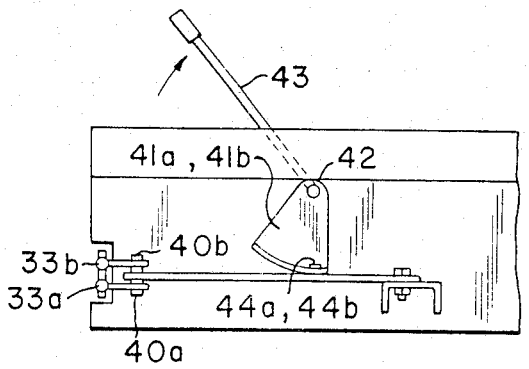
FIG. 16 and FIG. 17 show diagrammatical views of the operation of the FIG. 11 embodiment of a bed of the present invention.
Figure 17:
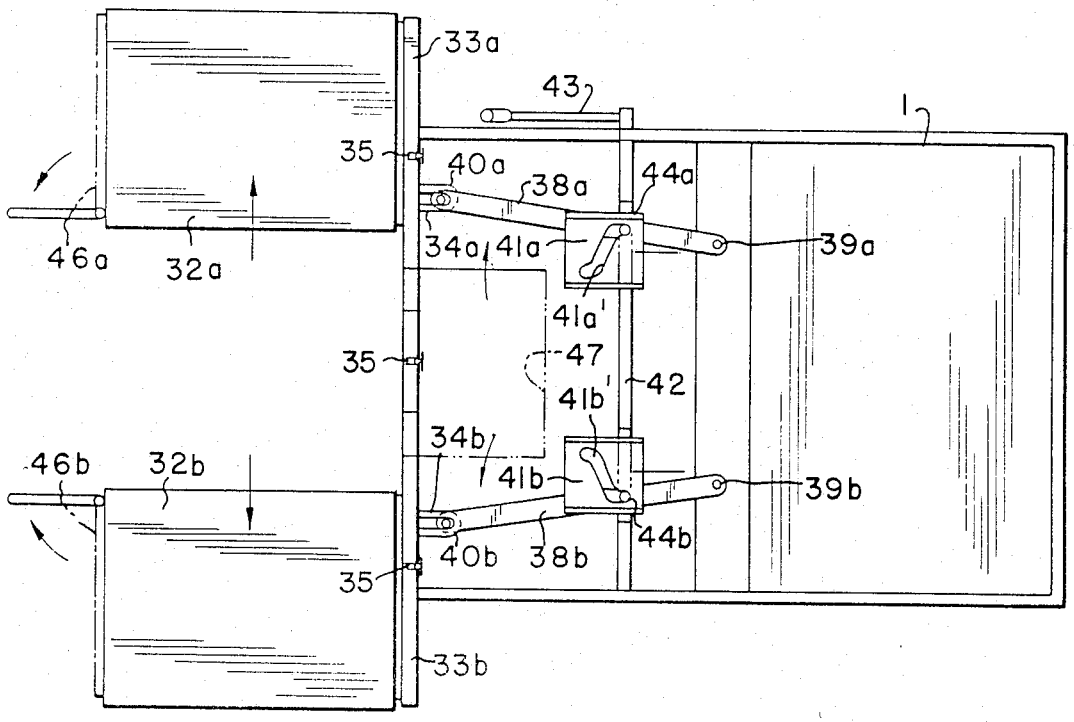

When the hand lever at the side of the fixed part 31 is raised as shown in FIG. 16, the oscillating cam members 41*a* and 41*b* oscillate on the axis of the operating shaft 42. In concert with the oscillating motion, the pins 44*a* and 44*b* of the operating rods 38*a* and 38*b* move along the cam slots 41*a*' and 41*b*', thus causing the operating rods 38*a* and 38*b* to swing as shown in FIG. 17. In swinging the operating rods 38*a* and 38*b*, the pins 40*a* and 40*b* at their tips force the U-shaped pieces 34*a* and 34*b* of the slide pipes 33*a* and 33*b* outward to the right and left sides, thus also forcing outward the right and left mobile parts 32*a* and 32*b*. When both the mobile parts 32*a* and 32*b* slide outwardly, the floor surface will appear in the central part.

When the floor surface appears, the patient, who has beforehand risen halfway with the help of the back rest 45 raised with some conventional drive means, can put his feet on the floor surface, take a sit-down position and then stand up and further step forward with no difficulty. Furthermore, the patient may turn hand rails 46*a* and 46*b* attached to the front edges of the mobile parts 32*a* and 32*b* as shown in FIG. 17 and use them for support to help start walking.

In the above described embodiment, the slide pipes 33*a* and 33*b* and support pipes 36*a* and 36*b* can be solid bars. Also, a bowel evacuation recess 47 may be provided, in which a chamber pot is contained.

Figure 18:
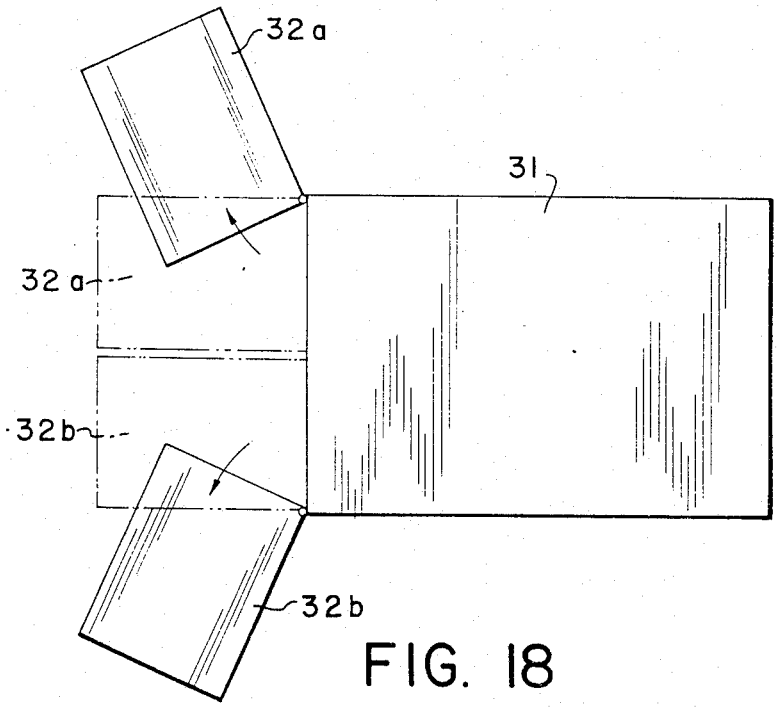
FIG. 18 schematically shows another embodiment of a bed of the present invention.

In FIG. 18, the mobile parts 32*a* and 32*b* are merely pivotable apart from one another and from the fixed part 31.

It will be obvious to those skilled in the art that various other changes and modifications may be made without departing from the scope of the invention and the invention is not to be considered limited to what is shown in the drawings and described in the specification.

What is claimed is:

1. A rehabilitation bed having a first frame portion and a second movable frame portion, said second mobile frame portion including left and right movable frame portions; a split mattress having a back and head supporting mattress section supported by said first frame portion and left and right mobile leg supporting mattress sections supported by said left and right movable frame portions, respectively; and means for causing said left and right mobile mattress sections and said left and right movable frame portions to split and move apart from one another towards left and right sides of the bed, respectively, to provide an opening therebetween.

2. A rehabilitation bed in accordance with claim 1 wherein said means for causing said left and right mobile mattress sections to move apart also constitutes means to cause at least parts of said right and left mobile mattress sections to descend toward the floor.

3. A rehabilitation bed according to claim 2 wherein said means for causing said right and left mobile mattress sections to move apart and descend comprises a parallelogram link mechanism, and said left and right movable frame portions comprises a pair of split-plates which support central parts of said right and left mobile mattress sections.

4. A rehabilitation bed in accordance with claim 1, wherein said mattress is provided with a bowel evacuation recess.

* * * * *